United States Patent [19]

Fillion

[11] 4,314,119

[45] Feb. 2, 1982

[54] CONTROL DEVICE FOR MOTOR-REDUCTION UNITS

[75] Inventor: Pierre Fillion, Ville la Grand, France

[73] Assignee: Etablissements Carpano & Pons, France

[21] Appl. No.: 142,050

[22] Filed: Apr. 21, 1980

[30] Foreign Application Priority Data

Apr. 25, 1979 [FR] France ..... 79 11205

[51] Int. Cl.[3] ..... H01H 3/16

[52] U.S. Cl. ..... 200/47; 200/38 R; 200/153 LB

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 47, 153 LB

[56] References Cited

U.S. PATENT DOCUMENTS

| | | | |
|---|---|---|---|
| 2,939,924 | 6/1960 | Franck | 200/153 LB X |
| 3,718,215 | 2/1973 | Mimeur | 200/47 |
| 4,130,746 | 12/1978 | Linstromberg | 200/38 R |
| 4,171,473 | 10/1979 | Hügin et al. | 200/47 |

*Primary Examiner*—Stanley J. Witkowski
*Assistant Examiner*—Morris Ginsburg
*Attorney, Agent, or Firm*—Robert E. Burns; Emmanuel J. Lobato; Bruce L. Adams

[57] ABSTRACT

This control device for electric motor-reduction unit intended for driving rolling shutters, roller-blinds or the like, and permitting an accidental overstepping of the electrical stop point without causing any damage in, or putting out of order, the control device, comprises a cam having a notch formed in its contour, adapted to be engaged by a follower portion of a lever so as to open a switch controlling the supply of drive current to the motor-reduction unit. The notch has a rear portion inclined laterally and rearwardly which opens into an extension of the cam contour which is level with the bottom of the notch, or located at a lower level than this bottom. When the cam rotating in a given direction oversteps the normal electrical stop point the inclined portion moves the follower laterally and the lever is moved laterally along its pivot axis against the force of spring means, but held at the same level.

9 Claims, 5 Drawing Figures

CONTROL DEVICE FOR MOTOR-REDUCTION UNITS

FIELD OF THE INVENTION

This invention relates to a control device for electric motor-reduction units, notably of the type intended for driving a rolling shutter, a roller-blind or the like. As a rule, control devices of this type comprise a movable control member having a first portion cooperatively associated with a switch controlling the operation of the motor-reduction unit, and a second portion adapted to engage a notch formed in the contour of at least one rotary cam, in order to actuate the switch for cutting off the supply of drive current to the motor-reduction unit when the rolling shutter, roller-blind or like device is wound up or unrolled completely.

DESCRIPTION OF THE PRIOR ART

In known control devices of this type, for instance the device disclosed in the French Pat. No. 1,539,452, the electrical switch-off point may be overstepped or cleared accidentally. This failure may occur for instance in case the switch is damaged and fails from stopping the motor at the proper time, but in most cases this occurs when the rolling shutter, roller-blind or the like comprises an auxiliary manual control means operable in case of failure of the electric supply mains. Due to the presence of this manually operated control device, the operator may be led to wind up or unroll the rolling shutter, roller-blind or the like beyond the limits set for the electric control means. This undesired overstepping of the electrical stop point is likely firstly to damage the cam and/or the switch control member, since the second portion of this last-mentioned member is not designed for easily moving out from the cam notch. Moreover, even if this second portion succeeds in moving out from the cam notch, it will lie at a level similar to the one it had before engaging said notch, this level corresponding to a position of the first portion of the movable control member in which the motor-reduction unit is expected to be supplied with energizing or drive current. In fact, when the mains supply is restored, if the rolling shutter or the like is in its rolled-up position, the motor-reduction unit may be driven electrically in a direction tending to wind it up to an additional extent. If this rolling shutter or the like is not provided with a mechanical stop member, as in most devices of this type, serious damages may occur.

On the other hand, this overstepping of the electrical stop point may give rise to another inconvenience, in that this point may become misadjusted. This is observed notably in a control device based on the principle set forth in the above-mentioned French patent, which further comprises a worm screw permitting the adjustment of the position of said electrical stop point. This worm was made of flexible material so that it can be disengaged from the pinion with which it is in normal driving engagement, when the second portion of the control member reacts against the bottom of the cam notch. This is detrimental to the subsequent operation of the electric control device, and a person skilled in the art is necessary for re-adjusting the position of the stop point.

SUMMARY OF THE INVENTION

With the control device according to this invention for motor-reduction units and the like the inconveniences found in prior art devices are safely avoided. In fact, with the present invention it is possible to overstep accidentally the electrical stop point of the motor-reduction unit, for example as a consequence of a switch failure or of an unduly extended actuation of the auxiliary manual control, without any risk of damaging the cam and/or the switch control member, without keeping the control member in a position likely to cause and enable an untimely starting of the motor when the drive current supply is restored, without causing any misadjustment of the position of the electrical stop point, and finally without any possibility of damaging the rolling shutter, roller-blind or the like. All these advantages are obtained by using an electrical control device which is both simple in design and extremely reliable in operation.

The control device according to this invention is characterized in that the rear portion of the notch is inclined backwards and laterally, and opens into a portion of the cam contour which is substantially level with, or at a lower level than, the notch bottom, so that the other portion of the movable control member and the rear inclined portion of the notch are capable, in case the cam were caused to rotate beyond the preset electrical stop point, of sliding on each other while resiliently and laterally moving the cam and/or the other portion of the movable control member.

In a typical form of embodiment of the invention, the movable control member is slidably movable at least substantially at right angles to the direction of movement of the cam contour and laterally towards the cam contour portion substantially level with, or at a lower level than the notch bottom, against the force of resilient means.

In a modified form of embodiment, it is only the second portion of the movable control member that can be moved by flexion at least substantially at right angles to the direction of movement of the cam contour and laterally towards the cam contour portion substantially level with, or at a lower level than the notch bottom.

In a further modified form of embodiment, it is the cam that is slidably movable along its pivot axis in a direction opposed to the portion of its contour which is substantially level with, or at a lower level than, the notch bottom, against the force of resilient means.

In another modified form of embodiment of the invention, the cam or cams, on the one hand, and the movable switch control member, on the other hand, are movable simultaneously and axially along their axes, respectively, but in opposed directions, against the force of corresponding resilient means.

DESCRIPTION OF THE PREFERRED EMBODIMENTS

Figure 1:
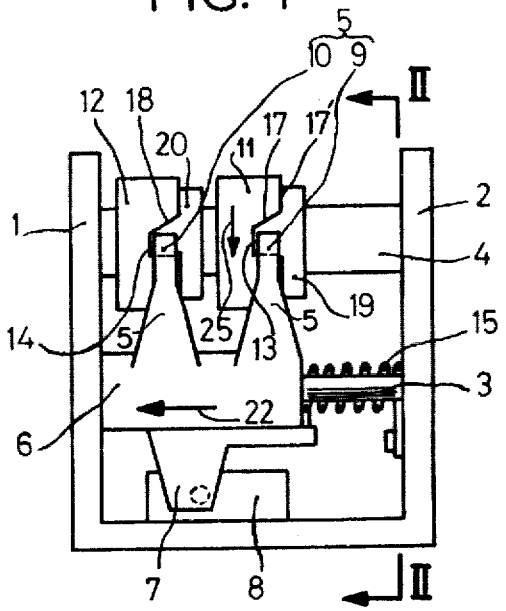
FIG. 1 is an elevational and diagrammatical view of a first embodiment of the invention, shown in its electrical stop condition.
Figure 2:
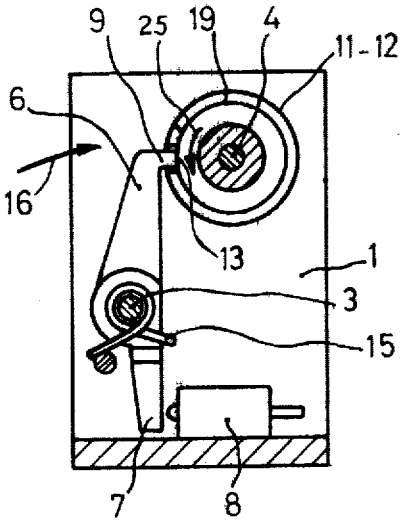
FIG. 2 is a section taken along the line II—II of FIG. 1, showing the first embodiment of the invention.
Figure 3:
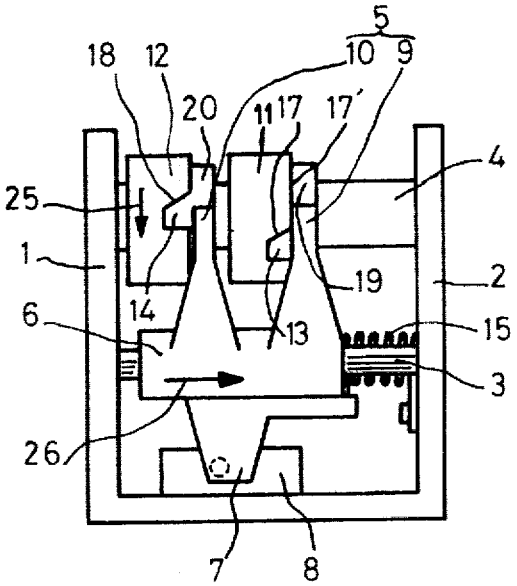
FIG. 3 is an elevational view showing in a manner similar to the one adopted in FIG. 1 the same first embodiment but in the condition obtaining when the electrical stop point has been overstepped.

Reference will be made firstly to FIGS. 1 to 3 of the drawing illustrating a typical form of embodiment of the control device of this invention, which comprises a substantially U-shaped support having a first upright flange 1 and a second upright flange 2 between and to which two parallel shafts 3,4 are mounted. Pivoted to shaft 3 is a movable control member in the form of a rocker 6 having a single depending arm 7 and a pair of axially-spaced upright coplanar arms 5. This rocker 6 may be molded from a suitable plastic material.

The depending arm 7 is adapted to actuate a switch 8 controlling the operation of a motor-reduction unit (not shown). Preferably, this switch 8 is of the front contact type, i.e. open when inoperative or not actuated by said arm 7. The upper portion of rocker 6 carries on its arms 5 a pair of cam follower projections 9,10 adapted to engage the peripheral contours of a pair of cams 11 and 12, respectively, pivoted to the other shaft 4. The cams 11, 12 are held against axial movement on shaft 4. The contour of each cam 11, 12 comprises a notch 13,14, respectively, these notches having dimensions sufficient to permit their engagement by the corresponding cam follower projections. In this example, the cams are driven at different speeds by a mechanism (not shown) coupled kinematically to the motor-reduction unit and to the winding rod of a rolling shutter, roller-blind or the like. A torsion spring 15 disposed about the shaft 3 constantly urges the projections 9,10 as shown by the arrow 16 of FIG. 2, i.e. for engagement with the corresponding contours of cams 11 and 12.

The rear portions of notches 13 and 14, designated by the reference numerals 17 and 18, respectively, are inclined upwardly and rearwardly in relation to the axis of shaft 4 and open into free shouldered portions 19,20 respectively of cam contours 11 and 12, each free portion 19,20 being substantially level with the bottom of the adjacent notch 13 or 14. Of course, it would not constitute a departure from the basic principles of this invention to have these free shouldered portions 19,20 located at a somewhat lower level than the bottom of notches 13 and 14; furthermore, these portions 19 and 20 may if desired be tapered and designed to merge into the notch bottoms. The torsion spring 15 is also a helical compression spring and constantly urges the rocker 6 in the direction of the arrow 22 towards the left-hand flange 1, as shown in FIG. 1.

When the rolling shutter, roller-blind or the like is fully wound up or unrolled, the notches 13,14 of cams 11 and 12 rotating in the direction of the arrow 25 the one (12) at low speed and the other (11) at a relatively high speed, are aligned with each other, as shown in FIG. 1, when the electrical stop point is reached. Both projections 9, 10 of rocker 6 then drop simultaneously into the corresponding notches 13 and 14. The first or depending arm 7 releases to its open position the previously closed switch 8 (held in this closed position by said arm 7 during the operating time of the motor-reduction unit), thus de-energizing the motor-reduction unit.

If, as a consequence of say, a failure in the supply of drive current to the motor-reduction unit, the winding rod of the rolling shutter, roller-blind or the like is rotatably driven by using auxiliary manually-operated means, such as a crank, the cam members 11 and 12 are rotated in the direction of the arrow 25 by this means. Thus, the cams 11 and 12 may possibly be rotatably driven beyond the position corresponding to this electrical stop point. In this case, the cam 11 rotated at a relatively fast speed in the direction 25, will push the end of projection 9 through the medium of the inclined portion 17 of its notch 13, thus causing the projection 9 and the complete rocker 6 to slide axially along the shaft 3 against the force of spring 15 in a direction 26 at right angles to the direction of movement 25 of the cam contours 11,12. Then projection 9 is caused to slidably engage the lateral face 17' of cam 11 which constitutes an extension of said inclined face 17. Though cam 12, rotating at a relatively low speed, does not appreciably overstep, in this example, the electrical stop point, the projection 10 of rocker 6 is also moved laterally and axially as shown by the arrow 26. During this movement of projections 9 and 10 in the direction 26, these projections may remain in the bottom of notches 13 and 14, due to the provision of the aforesaid free shouldered portions 19 and 20. Under these conditions, the various component elements are in the positions shown in FIG. 3. Thus, switch 8 is released by arm 7 and its contacts are opened, thus de-energizing the motor-reduction unit drive circuits. Under these conditions, the rolling shutter, roller-blind or like device cannot thereafter be operated electrically, except in a direction opposed to that of the last manual actuation. At the end of a predetermined angular movement of cams 11 and 12 in the direction opposite to 25, the projections 9 and 10 will move axially in the direction 22 together with rocker 6 when said projections are re-aligned with the corresponding notches 13 and 14.

Figure 4:
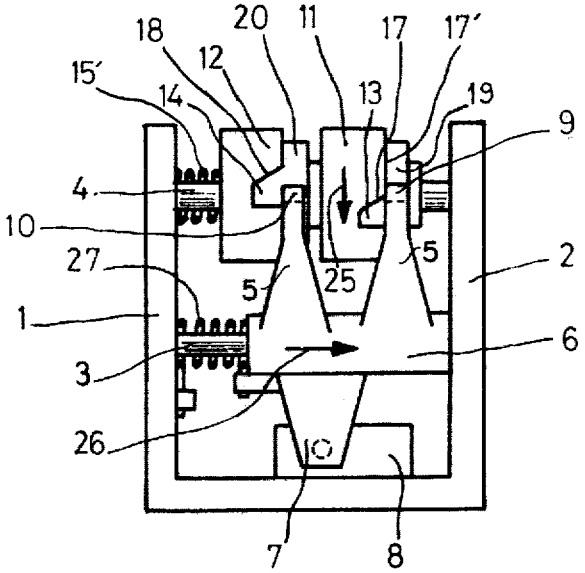
FIG. 4 is an elevational view showing a second embodiment.

In the second embodiment of the invention shown in FIG. 4, the rocker 6 is constantly urged to a fixed axial position in which it engages the right-hand flange 2 by a compression and torsion spring 27 urging at the same time the projections 9,10 for sliding contact with the contours of cams 11 and 12. These cams 11 and 12 are axially movable by sliding in a direction opposed to 26 on shaft 4, against the force of a compression spring 15' disposed about this shaft 4 and constantly urging the cams 11,12 against said flange 2. All the other component elements of the control device are otherwise identical with those of the first form of embodiment described hereinabove.

The mode of operation of this assembly is substantially similar to that of the first form of embodiment. Should cams 11,12 be driven accidentally for rotation in the direction 25 beyond the so-called electrical stop point, the projections 9,10 remain stationary, i.e. do not move in the direction 26, and the cams 11 and 12 are moved axially in the direction opposed to 26 until the face 17' slides along the projection 9 of rocker 6. When, subsequently, the cams 11 and 12 rotate in the direction opposed to 25, they move in the direction 26 when their notches are aligned with projections 9 and 10 and resume their normal position of operation.

Figure 5:
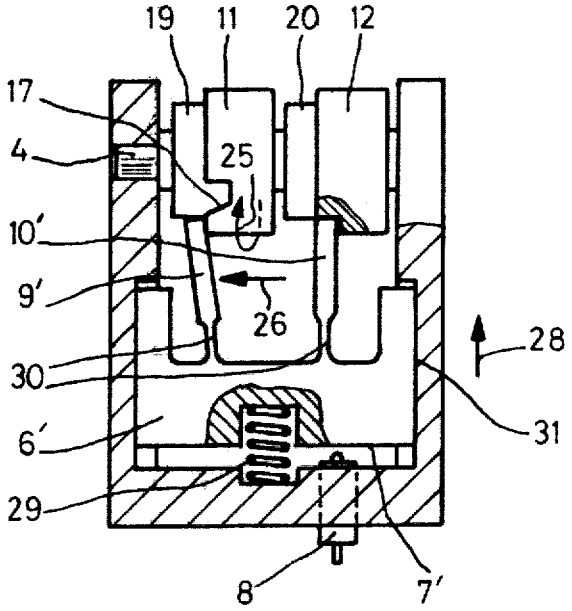
FIG. 5 is a section showing a third embodiment of the invention.

In a third embodiment of the invention partially illustrated in FIG. 5 the cams 11,12 are axially fixed on shaft 4. Shaft 3, rocker 6 and spring 15 of the first embodiment are replaced by a slide member 6' constantly urged upwardly by a compression spring 29, in the direction of the arrow 28. Switch 8 is adapted to be actuated by a first portion 7' of slide member 6'. The projections 9 and 10 of the preceding forms of embodiment are replaced by fingers 9', 10' comprising a narrow portion 30 permitting their lateral elastic distortion, by flexion, notably in the direction of the arrow 26. Side walls 31 are dimensioned to allow slide member 6' to travel in the direction of the arrow 28. The other component elements are identical with those of the first form of embodiment.

This assembly operates exactly as in the first embodiment. If the faster cam 11 is rotatably driven in the direction 25 beyond the electrical stop point, its inclined portion 17 will push laterally (in the direction of the arrow 26) the finger 9' undergoing an elastic deformation in this direction. However, since in this example the other finger 10' associated with the "slow" cam 12 is not subjected to any elastic deformation, the first portion 7' of slide member 6' is maintained in a position such that switch 8 remains in its release or open position.

It would not constitute either a departure from the basic principles of the invention to provide only one cam or more than two cams in the control device for an electric motor-reduction unit. Similarly, the contour of the cam or cams may be formed on the lateral cam faces instead of on the outer periphery thereof, said cams being in this case held in a fixed axial position on their shaft, and only the second portion of the movable member controlling the switch 8 is movable laterally.

The control device for an electric motor-reduction unit according to this invention is applicable notably for controlling rolling shutters or roller-blinds.

What is claimed is:

1. A control device, comprising:

at least one cam having a circumferential cam surface, a circumferential shoulder surface recessed relative to said circumferential cam surface, and a notch surface defining a notch in said circumferential cam surface adjacent said circumferential shoulder surface and opening to said circumferential shoulder surface;

cam mounting means mounting said cam for rotation about an imaginary axis of rotation with said circumferential cam surface rotatable circumferentially about the imaginary axis of rotation;

a control member having a projection defining a cam follower dimensioned to ride on said circumferential cam surface and be received within said notch and ride on said circumferential shoulder surface; and control member mounting means for pivotally and slidably mounting said control member to move said control member projection toward and away from said circumferential cam surface and generally parallel to the imaginary axis of cam rotation, said control member mounting means normally positioning said control member with said control member projection bearing against said circumferential cam surface, said control member pivoting to insert said control member projection into the notch in said circumferential cam surface when said cam rotates to bring said notch opposite said control member projection, and said control member sliding generally parallel to the imaginary cam axis of rotation along said notch surface as said cam rotates with said control member projection extending into said notch until said control member projection travels out of said notch onto said recessed circumferential shoulder surface to allow said cam to rotate beyond the position at which said control member projection extends into said notch.

2. A control device according to claim 1, further comprising:

biasing means for biasing said control member to pivot in a direction for pressing said control member projection against said circumferential cam surface and for biasing said control member to slide away from said circumferential shoulder surface to position said control member projection on said circumferential cam surface.

3. A control device according to claim 1, further comprising a switch actuated by said control member when said control member projection extends into said notch and when said control member projection rides on said circumferential shoulder surface.

4. A control device according to claim 1, wherein said cam mounting means is a shaft having a longitudinal axis extending along the imaginary axis of cam rotation.

5. A control device according to claim 4, wherein said cam is fixed on said shaft for rotation around said imaginary axis of rotation without translation along said shaft.

6. A control device according to claim 4, wherein said cam is mounted on said shaft for rotation around said imaginary axis of rotation and slidably for translation along said shaft.

7. A control device according to claim 6, further comprising biasing means for biasing said cam to slide along said shaft in a direction to position said cam with said circumferential cam surface opposite said control member projection and said control member projection riding on said circumferential cam surface, said control member pivoting to insert said control member projection into the notch in said circumferential cam surface when said cam rotates to position said notch opposite said control member projection, and said cam sliding along said shaft with said notch surface sliding along said control member projection as said cam rotates with said control member projection extending into said notch until said control member projection travels out of said notch onto said circumferential shoulder surface to allow said cam to rotate beyond the position at which said control member projection extends into said notch.

8. A control device according to claim 1, 2, 3, 4, 5, 6 or 7, comprising a plurality of cams each having a respective circumferential cam surface, circumferential shoulder surface and notch surface defining a notch in said circumferential cam surface adjacent said circumferential shoulder surface and opening to said circumferential shoulder surface;

said cam mounting means mounting said plurality of cams for rotation about the common imaginary axis of rotation; and said control member having a plurality of projections each defining a cam follower dimensioned to ride on said circumferential cam surface of a corresponding cam and be received within said notch and ride on said circumferential shoulder surface of the corresponding cam.

9. A control device, comprising:

at least one cam having a circumferential cam surface, a circumferential shoulder surface recessed relative to said circumferential cam surface, and a notch surface defining a notch in said circumferential cam surface adjacent said circumferential shoulder surface and opening to said circumferential shoulder surface;

cam mounting means mounting said cam for rotation about an imaginary axis of rotation with said circumferential cam surface rotatable circumferentially about the imaginary axis of rotation;

a control member having a flexible projection defining a cam follower dimensioned to ride on said circumferential cam surface and be received within said notch and ride on said circumferential shoulder surface; and control member mounting means for mounting said control member for movement in a direction generally perpendicular to the imaginary axis of cam rotation with said flexible projection in an unflexed condition riding on said circumferential cam surface, said flexible projection extending into said notch when said cam rotates to position said notch opposite said flexible projection, and said flexible projection flexing in a direction generally parallel to the imaginary cam axis of rotation along said notch surface as said cam rotates with said control member flexible projection extending into said notch until said control member flexible projection travels out of said notch onto said recessed circumferential shoulder surface to allow said cam to rotate beyond the position at which said control member flexible projection extends into said notch.

* * * * *